US008414101B2

(12) United States Patent
Anzai et al.

(10) Patent No.: US 8,414,101 B2
(45) Date of Patent: Apr. 9, 2013

(54) PRINTING APPARATUS

(75) Inventors: Sumito Anzai, Shiojiri (JP); Tomoyoshi Kakegawa, Matsumoto (JP)

(73) Assignee: Seiko Epson Corporation, Tokyo (JP)

( * ) Notice: Subject to any disclaimer, the term of this patent is extended or adjusted under 35 U.S.C. 154(b) by 71 days.

(21) Appl. No.: 13/192,136

(22) Filed: Jul. 27, 2011

(65) Prior Publication Data

US 2012/0026217 A1 Feb. 2, 2012

(30) Foreign Application Priority Data

Jul. 27, 2010 (JP) ..... 2010-167856

(51) Int. Cl.
*B41J 29/393* (2006.01)

(52) U.S. Cl. ..... 347/19; 347/5; 347/37

(58) Field of Classification Search ..... 347/5, 9, 347/14, 19, 37
See application file for complete search history.

(56) References Cited

U.S. PATENT DOCUMENTS 6,619,778 B2 * 9/2003 Igarashi ..... 347/19
2003/0193542 A1 * 10/2003 Kasahara ..... 347/37

FOREIGN PATENT DOCUMENTS

JP 2007283561 A 11/2007

* cited by examiner

*Primary Examiner* — Lam S Nguyen
(74) *Attorney, Agent, or Firm* — Nutter McClennen & Fish LLP; John J. Penny, V.

(57) ABSTRACT

A printing apparatus includes a motor that drives an object to be driven; a detection unit that detects the speed of the object to be driven; and a control unit that controls driving of the motor based on a speed profile including an acceleration range, a constant-speed range, and a deceleration range, and determines that the speed of the object to be driven is abnormal when the difference between the detection speed of the detection unit and the speed of the speed profile exceeds a threshold value, wherein a first threshold value is set in the constant-speed range, and a second threshold value, which is higher than the first threshold value, is set in at least a portion of the acceleration range and the deceleration range.

6 Claims, 5 Drawing Sheets

AT THE TIME OF MOVING RIGHT

AT THE TIME OF MOVING LEFT

| | CONSTANT-SPEED | ACCELERATION RANGE AND DECELERATION RANGE |
|---|---|---|
| ENERGY | GREAT | SMALL |
| OPERATION | STABLE | UNSTABLE |
| DISTANCE | LONG | SHORT |

PRINTING APPARATUS

BACKGROUND

1. Technical Field

The present invention relates to a printing apparatus.

2. Related Art

A printing apparatus (for example, an ink jet printer) includes various motors such as a carriage motor for moving a carriage in which a printing head is mounted, or a transport motor for transporting a medium (for example, sheet). In addition, a control unit of the printing apparatus drives the motors based on a predetermined speed profile.

For example, in the case of the carriage motor, the control unit drives the carriage motor with acceleration, a constant-speed, and deceleration whenever the carriage is reciprocated in the width direction of the medium. Then, when reciprocating the carriage motor, in some cases, the speed of the carriage cannot be controlled to a target speed due to paper jams, or the like. Therefore, a technology of estimating an obstruction to the carriage movement from the carriage speed and if it is determined that the carriage movement is abnormal, stopping the scanning of the carriage is suggested (JP-A-2007-283561).

As described above, when driving the motor with acceleration, a constant-speed, and deceleration, since the driving of the motor is stable in the constant-speed range, there is a low possibility that an abnormality may be false-detected. However, in the constant-speed range, energy is great and the distance (a movement distance) is long. Therefore, there is a concern that influence due to an abnormality (damage to the sheet or failure of the movement mechanism, and the like) may be great if an abnormality occurs.

On the other hand, in an acceleration range or a deceleration range, the driving operation of the motor is unstable. Therefore, there is a high possibility that an abnormality may be false-detected. However, in the acceleration range or the deceleration range, the energy is small and the distance (the movement distance) is short. Therefore, the influence is small even though an abnormality occurs.

Therefore, if the determination of the speed abnormality is performed by same determination reference, there is a concern that the measures may be not performed appropriately when an abnormality occurs.

SUMMARY

An advantage of some aspects of the invention is to provide a printing apparatus capable of appropriately performing the measures when an abnormality occurs.

According to an aspect of the invention, there is provided a printing apparatus including: a motor that drives an object to be driven; a detection unit that detects the speed of the object to be driven; and a control unit that controls driving of the motor based on a speed profile including an acceleration range, a constant-speed range, and a deceleration range, and determines that the speed of the object to be driven is abnormal when the difference between the detection speed of the detection unit and the speed of the speed profile exceeds a threshold value, wherein a first threshold value is set in the constant-speed range, and a second threshold value, which is higher than the first threshold value, is set in at least a portion of the acceleration range and the deceleration range.

Other aspects of the invention are obvious from the specification and the accompanying drawings of the invention.

BRIEF DESCRIPTION OF THE DRAWINGS

The invention will be described with reference to the accompanying drawings, wherein like numbers reference like elements.

DESCRIPTION OF EXEMPLARY EMBODIMENTS

Figure 1:
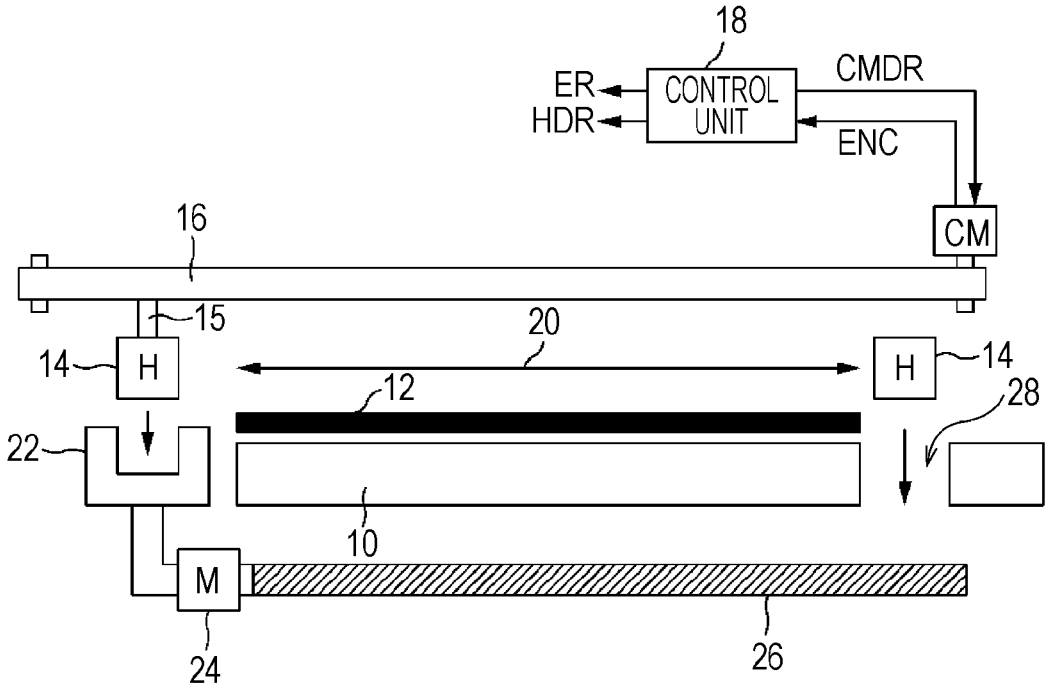
FIG. 1 is a schematic configuration diagram showing an ink jet printer.

According to the specification and the accompanying drawings, following descriptions are clarified.

A printing apparatus including: a motor that drives an object to be driven; a detection unit that detects the speed of the object to be driven; and a control unit that controls driving of the motor based on a speed profile including an acceleration range, a constant-speed range, and a deceleration range, and determines that the speed of the object to be driven is abnormal when the difference between the detection speed of the detection unit and the speed of the speed profile exceeds a threshold value, wherein a first threshold value is set in the constant-speed range, and a second threshold value, which is higher than the first threshold value, is set in at least a portion of the acceleration range and the deceleration range.

According to the printing apparatus, the threshold value, which determines that the object to be driven is abnormal, is different to each other in at least a portion of a constant-speed portion and acceleration and deceleration portions. Therefore, it is possible to appropriately perform the measures when an abnormality occurs.

In the printing apparatus, it is preferable that the first threshold value and the second threshold value are determined when the detection speed of the detection unit is lower than the speed of the speed profile.

According to the printing apparatus, it is possible to detect an abnormality when the speed of the object to be driven is decreased due to obstacles or the like.

In the printing apparatus, it is preferable that the first threshold value and the second threshold value are determined when the detection speed of the detection unit is higher than the speed of the speed profile.

According to the printing apparatus, it is possible to detect an abnormality at a case where the speed is increased, for example, at a case where the object to be driven runs out of control.

In the printing apparatus, it is preferable that the difference between the detection speed of the detection unit and the speed of the speed profile is calculated for each period which is predetermined, and that the period is set to be longer than the constant-speed range in at least a portion of the acceleration range and the deceleration range.

According to the printing apparatus, a calculation amount which is performed by the control unit can be decreased in portions other than the constant-speed portion, and a detection accuracy of an abnormality can be improved in the constant-speed portion. Therefore, an abnormality detection can be efficiently performed.

In the printing apparatus, it is preferable that the second threshold value has a magnitude in which the speed of the object to be driven is not determined to be abnormal regardless of the detection speed value of the detection unit.

According to the printing apparatus, the comparison cannot be performed in portions in which the movement is unstable. Therefore, the calculation amount which is performed by the control unit can be decreased.

In the printing apparatus, it is preferable that the object to be driven is a carriage in which a printing head is mounted and which reciprocates in the width direction of a medium within a movement range, and that at least a portion of the acceleration range and the deceleration range is a range other than the printing range within the movement range.

According to the printing apparatus, it is possible to prevent the printing quality from deteriorating.

In embodiments described below, an ink jet printer will be described as an example of a printing apparatus.

Embodiment

With Respect to Printer Configuration

Figure 2:
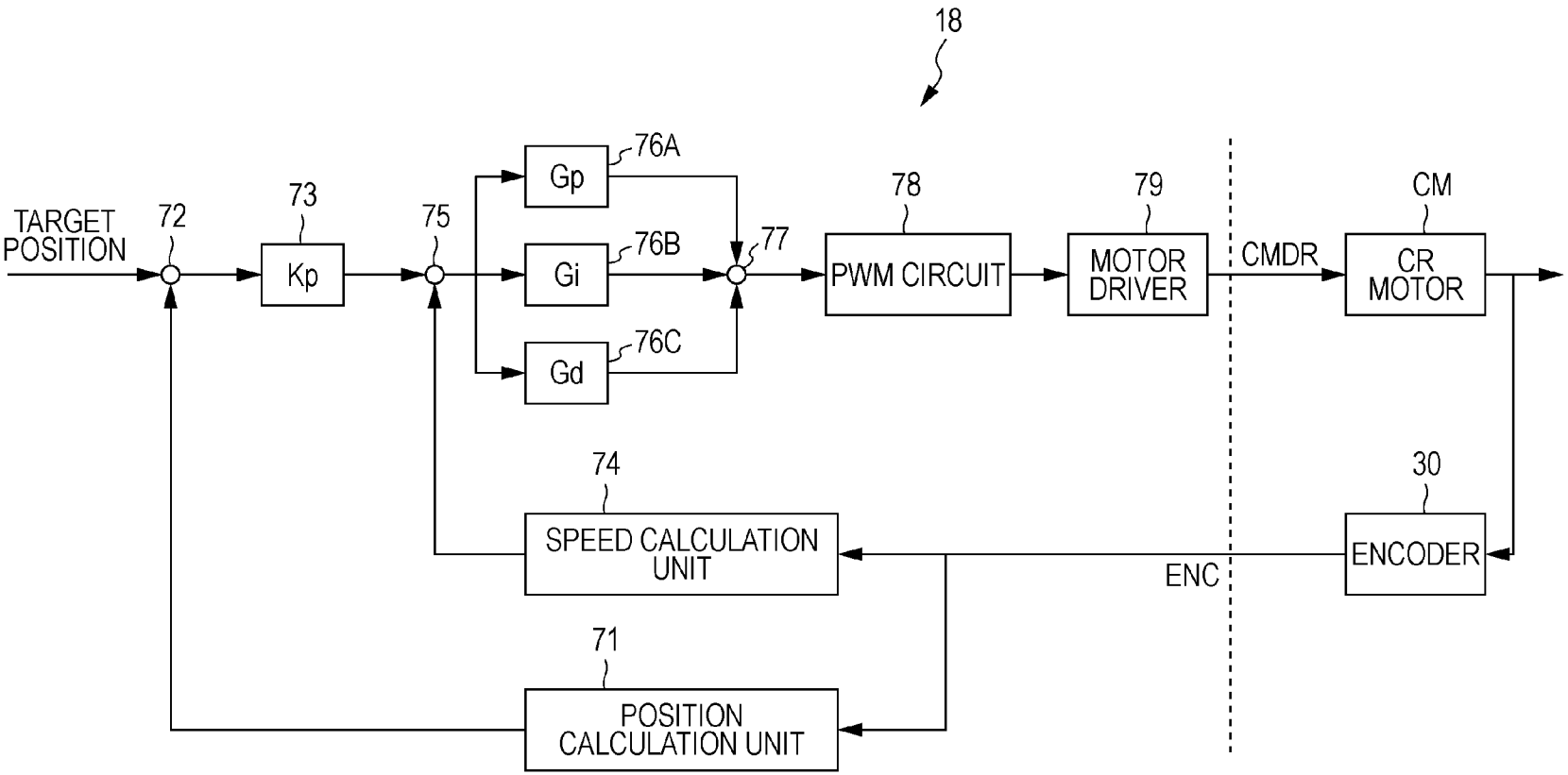
FIG. 2 is a block diagram showing a configuration of a part which controls driving of a carriage motor in a control unit.

FIG. 1 is a schematic configuration diagram showing an ink jet printer. In addition, FIG. 2 is a block diagram showing a configuration of a part which controls the driving of a carriage motor in a control unit.

As shown in FIG. 1, a sheet feed mechanism (not shown) is installed in a platen 10 in which sheet 12 serving as a printing medium is disposed, and the sheet 12 is moved in a secondary scanning direction. On the platen 10, a carriage 14 in which a recording head H is mounted is installed, and the carriage 14 is reciprocated in the width direction (a primary scanning direction) of the sheet 12 within a movement range 20. In order to be capable of reciprocation, the carriage 14 is connected to a timing belt 16, which is driven by a carriage motor CM, via a connector 15.

The recording head H and an ink tank (not shown) are installed in the carriage 14, and, in the ink tank, the ink is supplied from an ink cartridge (not shown), which is mounted to a main body side, via an ink supply tube (not shown). In addition, an ink droplet is ejected from an ink nozzle by a piezoelectric element or a heater element in the recording head H.

Moreover, a cap 22 is installed at the left end of the platen 10. The cap 22 covers the ink nozzle of the recording head H in a state of non-printing and prevents the ink in the ink nozzle from drying. In addition, the ink droplet in the ink nozzle is sucked in by an ink suction motor 24 which is connected to the cap 22 if necessary, and the ink nozzle is cleaned. On the other hand, a flushing hole 28 is installed at the right end of the platen 10, for each a predetermined time interval or a predetermined printing amount, the recording head H of the carriage 14, which is moved to the right end of the platen 10, discharges the ink droplet. Therefore, it is possible to prevent the ink in the ink nozzle from hardening. An absorber 26 is installed to be opposite to the flushing hole 28 and absorbs the ink droplet which is ejected from the flushing hole 28. In addition, the absorber 26 absorbs the ink which is sucked in by the ink suction motor 24.

The control unit 18, which is constituted from a microprocessor and the like, inputs an encoder output ENC from an encoder 30 (refer to FIG. 2) which is attached to the carriage motor CM. Moreover, the control unit 18 monitors positions of the carriage 14 by counting the encoder output ENC or the like. In addition, the control unit 18 outputs a drive command CMDR to the carriage motor CM, controls the driving of the carriage motor CM, and reciprocates the carriage 14 within the movement range 20. In addition, the control unit 18 outputs a head driving signal HDR which drives the piezoelectric element or the heater element in the recording head H based on the printing data, and an error signal ER when a predetermined error is generated. Further, the control unit 18 outputs the error to a display panel or an error lamp (not shown).

With Respect to Configuration of Control Unit

As shown in FIG. 2, the control unit 18 includes a position calculation unit 71, a subtractor 72, a gain 73, a speed calculation unit 74, a subtractor 75, a proportional element 76A, an integrator element 76B, a differential element 76C, an adder 77, a PWM circuit 78, and a motor driver 79.

Moreover, in the embodiment, the carriage motor CM is controlled by a PID type. In the PID control, a target rotation speed is calculated by multiplying a position deviation between a target rotation position and a real rotation position which is obtained from the output of the encoder 30 by the gain Kp. In addition, the control unit 18 performs calculations of a proportional component, an integral component, and a differential component by using the proportional element 76A, the integrator element 76B, and the differential element 76C based on a speed deviation between the target rotation speed and the real rotation speed obtained from the output of the encoder 30. Moreover, the control unit 18 controls the carriage motor CM based on the sum of the calculation result.

The position calculation unit 71 detects an edge of the output pulse of the encoder 30, counts the number of edges, and calculates the rotation position of the carriage motor CM based on the counted value. The position calculation unit 71 performs a counting process so as to recognize a normal rotation and a reverse rotation of the carriage motor 32 from a proportional processing of two pulse signals and perform an increment and a decrement according to the normal rotation and the reverse rotation when one edge is detected.

The subtractor 72 calculates the position deviation between the target position and the detection position which is detected by the position calculation unit 71. The gain 73 multiplies the position deviation, which is output from the subtractor 72, by the gain Kp and outputs a target speed. The gain Kp is determined according to the position deviation. In addition, a table, which indicates a relationship between the value of the gain Kp and the position deviation, is stored in a memory (not shown) or the like.

The speed calculation unit 74 (corresponding to a detection unit) calculates the rotation speed of the carriage motor CM based on the output pulse of the encoder 30. That is, the speed calculation unit 74 times the pulse period of the output pulse of the encoder 30 and calculates the rotation speed of the carriage motor CM based on the pulse period. In other words, the speed calculation unit 74 detects the speed of the carriage 14.

The subtractor 75 calculates the speed deviation between the target speed which is output from the gain 73 and the detection speed which is detected by the speed calculation unit 74.

The proportional element 76A multiplies the speed deviation by a constant Gp and outputs the proportional component. The integrator element 76B integrates the value which is obtained by multiplying the speed deviation by a constant Gi and outputs the integral component. The differential element 76C multiplies a difference between a current speed deviation and the just previous speed deviation by a constant Gd and outputs the differential component. The calculations of the proportional element 76A, the integrator element 76B, and the differential element 76C are performed for each one period of the output pulse of a linear type encoder 51.

The signal values, which output from the proportional element 76A, the integrator element 76B, and the differential element 76C, are signals which indicate duties according to the respective calculation results.

The adder 77 adds the output of the proportional element 76A, the output of the integrator element 76B and the output of the differential element 76C.

The PWM circuit 78 generates a command signal based on the duty signal which is output from the adder 77.

The motor driver 79 drives the carriage motor based on the command signal from the PWM circuit 78. For example, the motor driver 79 includes a plurality of transistors. Moreover, the motor driver 79 causes the transistors to be in an ON/OFF state based on the command signal from the PWM circuit 78, and therefore, the motor driver 79 supplies power to the carriage motor CM.

With Respect to Carriage Speed Abnormalities

Figure 3:
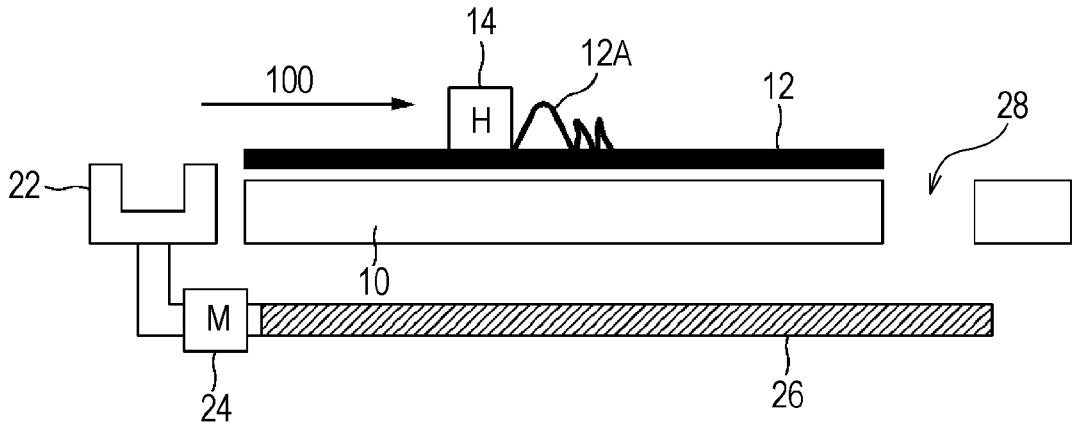
FIG. 3 is a diagram showing an example of a state where paper jams occur during printing.

FIG. 3 is a diagram showing an example of a state where paper jams occur during printing. FIG. 3 shows a case where the carriage 14 cannot be moved due to the paper jam 12A during when the carriage 14 is moved from a left end, in which the cap 22 is installed, in the right direction 100. In this case, the speed of the carriage 14 is decreased, and the carriage cannot be controlled to the target speed.

In addition, in the state of FIG. 3, there may be a case where the carriage 14 runs out of control due to the speed of the carriage 14 beyond the target speed, such as a case where the sheet 12 is torn due to the continuously forcible driving of the carriage 14 or a case where the movement mechanism of the carriage 14 fails.

Accordingly, it is necessary to monitor the speed of the carriage 14 and detect the occurrence of an abnormality as described above. In the embodiment, as described below, an abnormality is detected by comparing the speed which is calculated based on the encoder output ENC and the speed (the target speed) of a speed profile.

With Respect to Encoder Output

Figure 4A:
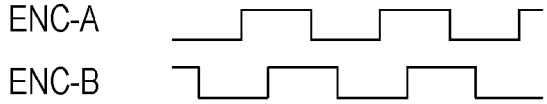
FIGS. 4A and 4B are wave charts showing output forms of a pair of encoders which are installed in a carriage motor.
Figure 4B:
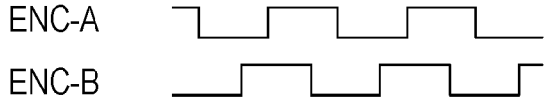

FIGS. 4A and 4B are wave charts showing output forms of a pair of encoders which are installed in the carriage motor. FIG. 4A is the output wave form of the encoder 30 when the carriage motor CM is rotated in one direction and the carriage 14 is moved in the right direction. A phase of an output ENC-A of one (is given as an encoder A) of the encoder 30 is led to a phase of on output ENC-B of the other one (is given as an encoder B), and if the rotation speed of the carriage motor CM is constant, a period of the encoder output also becomes constant. FIG. 4B shows an output wave form of the encoder when the carriage motor CM is rotated in the reverse direction and the carriage 14 is moved in the left direction. In this case, the phase of an output ENC-B of the encoder B is led to a phase of on output ENC-A of the encoder A. The control unit 18 counts according to the phase conditions of the encoder outputs ENC and continuously understands the position or the speed of the carriage 14.

With Respect to Abnormality Determination

The control unit 18 of the embodiment obtains a difference between the target speed and the movement speed of the carriage 14 (hereinafter, also referred to as "a detection speed"), and therefore, performs an abnormality determination (hereinafter, also referred to as "an abnormality check") based on the speed difference. In addition, when the difference between the target speed and the detection speed exceeds a threshold value, the control unit 18 determines that the abnormalities such as the paper jams or the failure of the motor occur, and stops the driving of the carriage motor CM.

Figures 5, 6:
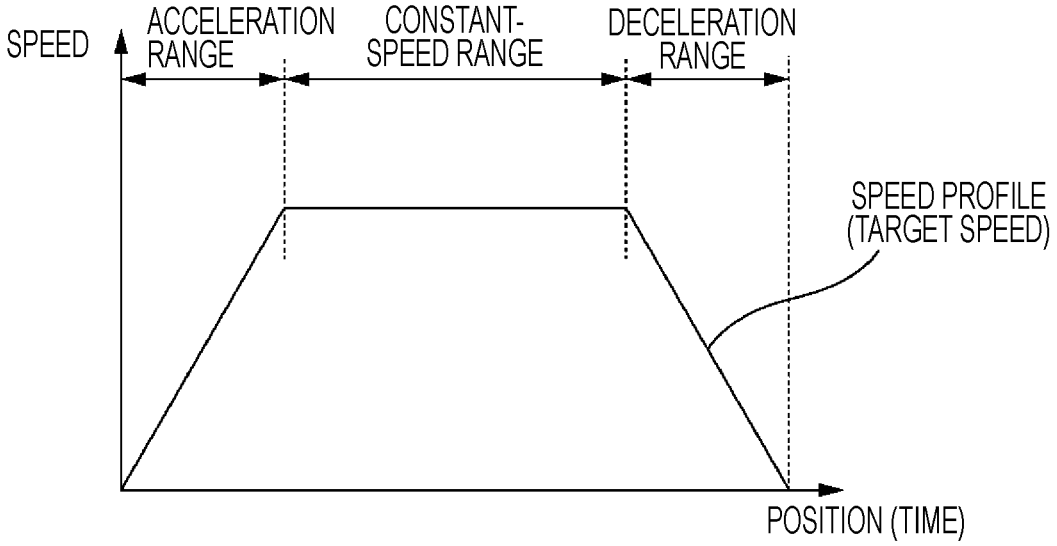
FIG. 5 is an explanatory diagram showing a speed profile of a carriage motor.
FIG. 6 is a diagram showing a comparison between a constant-speed range and an acceleration and deceleration range.

FIG. 5 is an explanatory diagram showing an example of the speed profile of a carriage motor. In FIG. 5, the transverse axis is the position (the time), and the longitudinal axis is speed.

As shown in FIG. 5, in the speed profile of the embodiment, there are an acceleration range in which the carriage motor is accelerated from the stopping state to a predetermined speed, a constant-speed range in which the carriage motor is maintained to the predetermined speed, and a deceleration range in which the carriage motor is decelerated from the predetermined speed to the stopping state. Hereinafter, the acceleration range and the deceleration range are collectively also referred to as an acceleration and deceleration range. In addition, in practice, the constant-speed range is longer than the acceleration range and the deceleration range. However, for the sake of simplicity in FIG. 5, the portion of the constant-speed range is shortly shown. The control unit 18 controls the driving of the carriage motor CM based on the above-described speed profile (the target speed).

FIG. 6 is a diagram showing a comparison between a constant-speed range and an acceleration and deceleration range.

As shown in FIG. 6, when comparing the constant-speed range and the acceleration and deceleration range, energy (speed energy) of the constant-speed range is greater than that of the acceleration and deceleration range, and the movement of the constant-speed range is more stable than that of the acceleration and deceleration range. Moreover, the distance (the movement distance) of the constant-speed range is longer than that of the acceleration and deceleration range. Therefore, when the paper jams in the carriage motor 14 as described in FIG. 3 occurs in the constant-speed range, there is a concern of tearing the sheet 12, and a tear amount of the sheet 12 is much.

On the other hand, in the acceleration and deceleration range, the movement is unstable (that is, it is difficult to control to the target speed). However, as compared to the constant-speed range, the energy (the speed energy) of the acceleration and deceleration range is smaller than that of the constant-speed range, and the distance of the acceleration and deceleration range is shorter than that of the constant-speed range. That is, in the acceleration and deceleration range, even though the carriage 14 collides with the paper jams, the tear amount of the sheet 12 is less.

Therefore, if the condition (the threshold value) for detecting an abnormality in the acceleration and deceleration range is the same as that of the constant-speed range, there is a concern that the measures may be not appropriately performed. For example, if the threshold value is strictly set in the acceleration and deceleration range in which the movement is unstable, there is a concern that the movement may be determined to be abnormal even though the movement is a normal state. On the other hand, if the threshold value is loosely set in the constant-speed range, the abnormality detection is late in the case where an abnormality occurs, and there is a concern that damage such as tearing of the sheet 12 or the failure of the movement mechanism may be serious.

Therefore, in the embodiment, the threshold values are different to each other in at least a portion of the constant-speed range and the acceleration and deceleration range. Specifically, the threshold value is strictly (low) set in the constant-speed range and is loosely (high) set in at least a portion of the acceleration and deceleration range.

Figure 7:
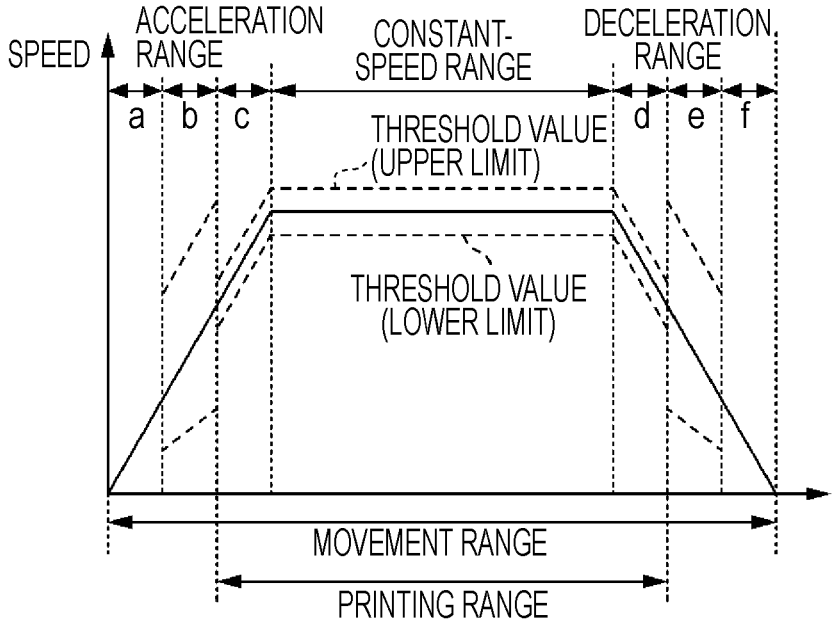
FIG. 7 is an explanatory diagram showing settings of threshold values in the present embodiment.

FIG. 7 is an explanatory diagram showing settings of threshold values in the embodiment.

In the embodiment, as shown in FIG. 7, the acceleration range is divided into three ranges of a to c, and the deceleration range is divided into three ranges of d to f. In addition, as shown in FIG. 7, among the movement range of the carriage 14, the ranges from the range c of the acceleration range to the range d of the deceleration range become a range (a printing range) in which the printing is performed on the sheet 12.

In FIG. 7, the determination conditions of an abnormality (threshold values) in the ranges (ranges a and b) of the acceleration range and the ranges (ranges e and f) of the deceleration range which are outside the printing range are set higher than the threshold value of the constant-speed range. Specifically, the threshold value in the printing range is set to +10% (the upper limit) and −10% (the lower limit) of the target speed. On the other hand, the threshold values in the ranges b and e are set to +50% (the upper limit) and −50% (the lower limit) of the target speed. In addition, in the ranges a and f in which the movement is most unstable among ranges other than the printing range, the threshold values are infinitely set. That is, in the ranges a and f, the speed of the carriage 14 is not determined to be abnormal regardless of the value of the detection speed. Therefore, it is not necessary to compare the speed difference between the target speed and the detection speed, and therefore, the calculation amount can be decreased.

In addition, in the embodiment, similarly to the threshold value, the interval (the period), which performs an abnormality check, also is varied according to the range. For example, in the printing range (the constant-speed range, the acceleration range c, and the deceleration range d), the interval performing an abnormality check is short. On the other hand, in the acceleration range b and the deceleration range e, the interval performing an abnormality check is longer than that of the printing range. In addition, an abnormality check is not performed in the acceleration range a and the deceleration range f. Therefore, the detection accuracy of the speed abnormality can be improved in the constant-speed range, the acceleration range c, and the deceleration range d. Moreover, the calculation amount for performing an abnormality check can be decreased in the acceleration range b, the acceleration range c, the deceleration range d, the deceleration range f.

As described above, in the embodiment, the determination condition (the threshold value) of an abnormality is strictly set in the constant-speed portion. Therefore, for example, an abnormality can be rapidly detected in the case where the speed of the carriage 14 is decreased due to the paper jam 12A as shown in FIG. 3. On the contrary, similarly even in the case where the carriage 14 runs out of control, it is possible to rapidly detect that the speed is increased. Therefore, an abnormality can be rapidly detected, in the case when an abnormality is detected, the carriage motor CM is stopped. Thus, it is possible to decrease damage such as tearing of the sheet 12 or the failure of the movement mechanism.

On the other hand, in a portion (which is ranges other than the printing range) of the acceleration and deceleration range, since the threshold value of the portion is set so as to be higher than that of the constant-speed range, an abnormality is difficult to be detected. Therefore, it is possible to prevent a false-detection of an abnormality due to the fact that the movement is unstable. In addition, even in the ranges other than the printing range, the acceleration range and the deceleration range are divided into a plurality of ranges, the threshold values are infinite (an abnormality detection need not be performed) in the outmost side ranges a and f of the movement range, and therefore, the calculation amount can be decreased.

As described above, the control unit 18 compares the detection speed of the carriage 14, which is detected based on the detected signal ENC of the encoder 30, and the speed (the target speed) of the speed profile. Thereafter, if the difference exceeds the threshold value, it is determined that the speed of the carriage 14 is abnormal. Moreover, in the embodiment, the threshold value is strictly (lower) set in the constant-speed range, and the threshold value of a portion (ranges other than the printing range in FIG. 7) of the acceleration range and the deceleration range is set more loosely (higher) than that of the constant-speed range.

Therefore, an abnormality determination can be performed according to the driving condition of the carriage 14, and the measures can be appropriately performed when an abnormality occurs.

Modification

In the above-described embodiment (FIG. 7), the threshold values of the ranges a and f of the outermost side of the movement range are set so as to be higher (the threshold values are infinite) than the threshold values of the ranges b and e. However, the threshold values of the ranges a and f may be set to the same (±50% of the target speed) as the threshold values of the ranges b and e.

In addition, the threshold values of the ranges a, b, e, and f, which are outside the printing range, may be infinite, and in the ranges a, b, e, and f, the comparison between the detection speed and the target speed may be not performed.

Moreover, the above-described embodiment (FIG. 7), the threshold values of the ranges c and d, which are near the constant-speed range, may be set to be higher than the threshold value of the constant-speed range. For example, the threshold values of the ranges c and d may be set to be ±30% of the target speed.

Another Embodiments

In the embodiment and modification, the printer or the like is described as examples. However, the embodiment and modification are for easy understanding of the invention and not interpreted to limit the invention. It is needless to say that the invention may be modified and improved without departing the gist thereof and include the equivalents thereof.

For example, in the above-described embodiment and modification, the control of the carriage motor CM which controls the movement of the carriage 14 is described. However, the invention is not limited to this, and the invention may be similarly applied to a control of the transport motor, which transports the sheet 12, and the abnormality detection may be performed.

In addition, in the above-describe embodiment and modification, the threshold values are set to the upper limit and the lower limit with respect to the target speed. However, the threshold value may be set to any one of the upper limit and the lower limit. For example, in the ranges other than the printing range, since there is a low possibility that the speed is decreased due to the paper jams, only the upper limit of the threshold values may be set so as to detect the carriage 14 running out of control only.

In addition, in the above-described embodiment and embodiment, the ranges, which are from the acceleration range c to the deceleration range d, are set as the printing range. However, the printing range is not limited to this. For example, the ranges, which are from the acceleration range b to the deceleration range e, may be set as the printing range, or only the constant-speed range may be set as the printing range.

In addition, the threshold values as shown in FIG. 7 may be stored in memory or the like as data (table) similarly to the speed profile. In this case, the calculations for calculating the threshold values need not be applied. On the other hand, if the percentage (%) of the threshold value to the speed of the speed profile is set for each range, the threshold value of each range can be calculated by performing the calculation based on the speed of the speed profile. Therefore, the amount of data can be decreased.

What is claimed is:

1. An printing apparatus comprising:

a motor that drives a carriage in which a printing head is mounted and which reciprocates in a width direction of a medium within a movement range;

a detection unit that detects a speed of the carriage; and a control unit that controls driving of the motor based on a speed profile including an acceleration range, a constant-speed range, and a deceleration range, and determines that the speed of the carriage is abnormal when the difference between the detection speed of the detection unit and the speed of the speed profile exceeds a threshold value, wherein a second threshold value is set in at least a portion of the acceleration range and the deceleration range, and a first threshold value, which is more strict than the second threshold value, is set in the constant-speed range.

2. The printing apparatus according to claim 1, wherein the first threshold value and the second threshold value are determined when the detection speed of the detection unit is lower than the speed of the speed profile.

3. The printing apparatus according to claim 1, wherein the first threshold value and the second threshold value are determined when the detection speed of the detection unit is higher than the speed of the speed profile.

4. The printing apparatus according to claim 1, wherein the difference between the detection speed of the detection unit and the speed of the speed profile is calculated for each period which is predetermined, and the period is set to be longer than the constant-speed range in at least a portion of the acceleration range and the deceleration range.

5. The printing apparatus according to claim 1, wherein the second threshold value has a magnitude in which the speed of the carriage is not determined to be abnormal regardless of the detection speed value of the detection unit.

6. The printing apparatus according to claim 1, wherein at least a portion of the acceleration range and the deceleration range is a range other than the printing range of the movement range.

* * * * *